United States Patent [19]

Takeda et al.

[11] Patent Number: 4,727,847

[45] Date of Patent: Mar. 1, 1988

[54] PRESSURE CONTROLLER FOR SUPERCHARGED INTERNAL COMBUSTION ENGINES

[75] Inventors: Toshio Takeda; Noriyoshi Shibata, both of Nagoya; Toru Tamura, Obu, all of Japan

[73] Assignee: Aisin Seiki Kabushiki Kaisha, Kariya, Japan

[21] Appl. No.: 837,274

[22] Filed: Mar. 7, 1986

[30] Foreign Application Priority Data

Mar. 8, 1985 [JP] Japan ..... 60-46131

[51] Int. Cl.[4] ..... F02B 33/38

[52] U.S. Cl. ..... 123/564

[58] Field of Search ..... 60/600, 601, 611; 123/559, 564

[56] References Cited

U.S. PATENT DOCUMENTS

| | | | |
|---|---|---|---|
| 4,227,372 | 10/1980 | Kakimoto et al. | 60/611 X |
| 4,565,178 | 1/1986 | Nagase et al. | 123/564 |
| 4,611,568 | 9/1986 | Onaka et al. | 123/564 |

FOREIGN PATENT DOCUMENTS

| | | | |
|---|---|---|---|
| 2328494 | 1/1975 | Fed. Rep. of Germany | 123/564 |
| 168217 | 9/1984 | Japan | 123/564 |

*Primary Examiner*—Michael Koczo

*Attorney, Agent, or Firm*—Oblon, Fisher, Spivak, McClelland & Maier

[57] ABSTRACT

A supercharged pressure controller for internal combustion engines, which comprises a switch valve for switching negative pressure at a throttle valve to atmospheric pressure and a relief valve operated by the signal from the switch valve to release the supercharged pressure in a surge tank, thereby controlling the supercharged pressure accurately in accordance with various running conditions of vehicle, avoiding inconveniences such as rough idling or knocking of engine.

2 Claims, 5 Drawing Figures

PRESSURE CONTROLLER FOR SUPERCHARGED INTERNAL COMBUSTION ENGINES

BACKGROUND OF THE INVENTION

1. Field of the Invention

The present invention relates to a supercharged pressure control apparatus to be used for an engine for automobiles equipped with supercharger.

2. Description of the Prior Art

The supercharger is a kind of air pump or blower installed in an inlet system of internal combustion engines to compress the intake air to a higher pressure than the atmospheric pressure in order to feed it into a cylinder. The object of installment of the supercharger is to increase the amount of air to be fed to the cylinder and to increase the output power that can be produced from an engine.

In an engine for automobiles with a supercharger, especially with a mechanically driven supercharger, it is necessary to optionally control the supercharged pressure according to operational conditions of the vehicle. In the conventional control system, there have been used a relief valve to control the supercharged pressure, as illustrated in FIG. 2, FIG. 3, FIG. 4 and FIG. 5. However, in the case of a supercharger for reciprocating engines such as shown in FIG. 2 and FIG. 3, the relief valve 2 operates to release air when the supercharged pressure exceeds a predetermined value, because the throttle 1 of the carburetor is closed at the time of reduced speed and idling, but the residual pressure remains in the surge tank 8 at time of reduced speed and idling and problems such as the occurrence of rough idling or the continuance of idling-up condition are caused, resulting in disadvantages such as an increase in fuel cost.

The supercharger in a reciprocating engine shown in FIG. 4 and FIG. 5 employs a system to control the relief pressure by utilizing the intake pressure of the intake manifold 4 to eliminate the aforementioned disadvantages. Since the pressure in the intake manifold 4 is negative at the time of reduced speed and idling, problems such as rough idling are overcome by lowering the operating pressure of the relief valve 2 by this negative pressure to lower the supercharged pressure in the surge tank 3.

In the case of the supercharger shown in FIG. 4 and FIG. 5, however, air is released when the pressure difference between the surge tank 3 and the intake manifold 4 has become greater than a predetermined value and at the time of reduced speed and idling, but when the engine 5 is running at a high speed (i.e. throttle in a fully open condition), the supercharged pressure in the surge tank 3 and the pressure in the intake manifold 4 become nearly the same, so that the pressure in the upper chamber A and lower chamber B of the relief valve 2 becomes the same, the relief valve does not open, and the surge tank 3 is charged with an abnormally high pressure, resulting in such disadvantages as knocking of the engine 5 and eventual damage of the engine.

SUMMARY OF THE INVENTION

The object of the present invention is to provide an improved supercharged pressure controller which can overcome inconveniences such as rough idling, an increase in fuel cost because of the continuing idle-up condition, and problems such as the occurrence of knocking or engine damage caused by an abnormally high supercharged pressure in the surge tank.

In accordance with the present invention, the supercharged pressure controller includes a relief valve comprising; a switch valve which operates to switch a negative pressure of throttle valve port of carburetor or intake manifold to atmospheric pressure according to the pressure signal (such as negative pressure, atmospheric pressure and positive pressure) which is output in accordance with the degree of engine throttle opening; a diaphragm which operates according to the signal pressure of said switch valve or the supercharged pressure in a surge tank of engine; and other valve mechanisms. The supercharged pressure controller of the present invention further includes a solenoid valve mechanism which controls the internal pressure of the surge tank by leading the supercharged pressure in the surge tank or the atmospheric pressure from an air filter to a port section of the relief valve according to the signal of the vehicle speed sensor, to cut the supercharged pressure at the high speed travel of the vehicle.

At the time of reduced speed or idling, the supercharged pressure in the surge tank is released by operating the relief valve by means of the negative pressure switch valve. During normal running, the supercharged pressure is controlled by a predetermined operating pressure of the relief valve. At the time of high speed running, the relief valve is operated by the solenoid controlled valve to release the supercharged pressure in the surge tank.

As stated in the discussion, the relief valve is opened at the time of reduced speed and idling, by combining the relief valve with a switch valve, thereby preventing rough idling and an increase in fuel cost. Also, during normal running, the engine power capability (torque, horse power) is improved by maintaining the internal pressure of the surge tank at the predetermined supercharged pressure. Therefore, the present invention permits accurate control of the supercharged pressure according to various running conditions and can provide a controller at a lower cost than the conventional system.

Other and further objects, features and advantages of the present invention will be understood more clearly and fully from the following detailed description of preferred embodiments with reference to the attached drawings.

BRIEF DESCRIPTION OF DRAWINGS

FIG. 3 is a schematic diagram of another conventional supercharged pressure controller.

DETAILED DESCRIPTION OF THE PREFERRED EMBODIMENT

Figure 1:
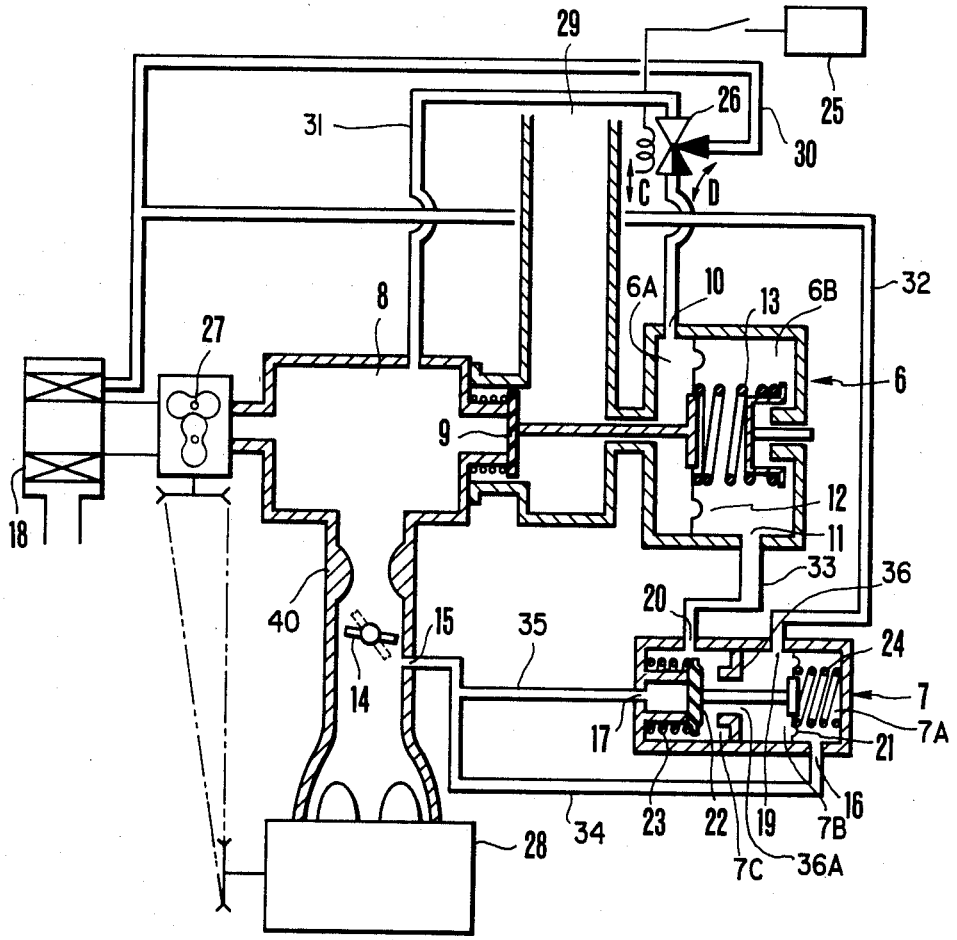
FIG. 1 is a schematic diagram showing the system of one embodiment of supercharged pressure controller according to the present invention.
Figure 2:
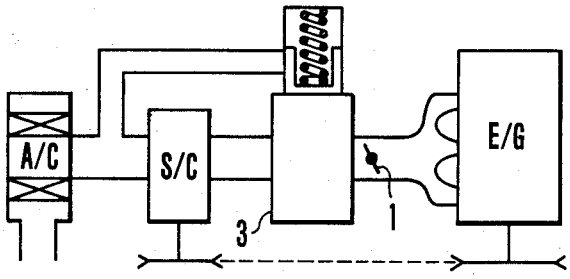
FIG.2 PRIOR ART
FIG. 2 is a schematic diagram of a conventional supercharged pressure controller.
Figure 3:
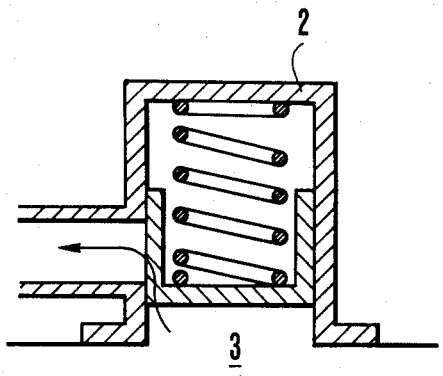
FIG.3 PRIOR ART
FIG. 3 is a partial schematic diagram showing the relief valve in the controller of FIG. 2.
Figure 4:
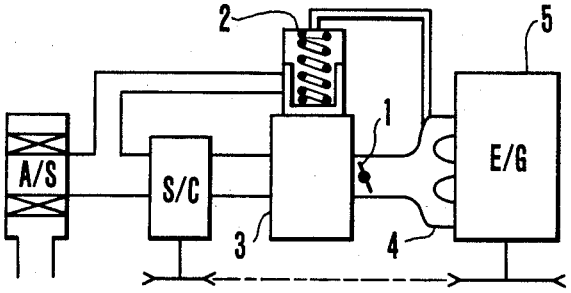
FIG.4 PRIOR ART
FIG. 4 is a partial schematic diagram showing the relief valve in the controller of FIG. 3.
Figure 5:
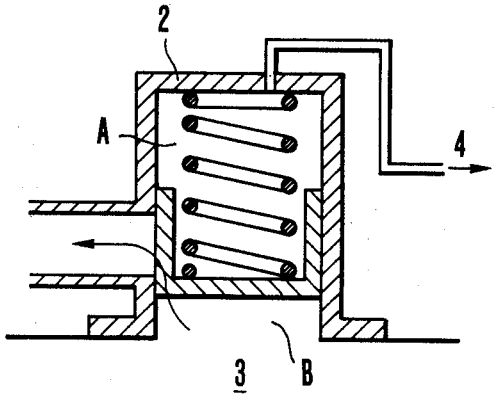
FIG.5 PRIOR ART
FIG. 5 shows another conventional supercharged pressure controller.

Referring to FIG. 1, a relief valve 6 and a switch valve 7 are disposed as means for controlling the supercharged pressure of the supercharger. The relief valve 6 is disposed so that the pressure of the surge tank is bypassed by a first valve 9. The relief valve 6 has a first port 10 for detecting the internal pressure of surge tank 8, a second port 11 that communicates with the switch valve 7, a first diaphragm 12 and a spring 13. The relief valve opens and closes the first valve 9 by the operation of first diaphragm 12.

The interior of the relief valve 6 is divided into a first chamber 6A and a second chamber 6B by the first diaphragm 12. The first valve 9 is fixed to the first diaphragm 12 and is normally biased in the direction to close the relief port 29. The first port 10 is formed in chamber 6A and communicates with the surge tank 8 through a passageway 31. The second port 11 is formed on the chamber 6B and communicates with the switch valve 7 through a passageway 33.

The switch valve 7 has, a third port 16 and a fourth port 17 that communicate with a throttle valve port 15 where a specific negative pressure is produced when a throttle 14 of carburetor is closed, a fifth port 19 that communicates with an air cleaner or air filter 18, and sixth port 20 that communicates with second port 11 of the aforementioned relief valve, as well as a second diaphragm 21 operated by a negative pressure signal of third port 16, a second valve 22 that opens and closes and which is interlocked with said diaphragm 21 and springs 23 and 24.

The throttle valve port 15 is formed downstream of the throttle valve 14 of the carburetor 40. The interior of the switch valve 7 is divided into a chamber 7A, a chamber 7B and a chamber 7C by the second diaphragm 21 and a partition 36. The second valve 22 is fixed to the second diaphragm 21 and biased normally in the direction to close the fourth port 17. The third port 16 is formed on chamber 7A and communicates with the throttle valve port 15. The fourth port 17 is formed on the chamber 7C and communicates with the throttle valve port 15 through a passageway 35 branched from the passageway 34. The fifth port 19 is formed on the chamber 7B and communicates with the air filter 18 through a passageway 32. The sixth port 20 is formed the chamber 7B and communicates with the chamber 6B of the relief valve 6 through the passageway 33.

The passageway 31 connecting the port 10 to the surge tank 8 is provided with a solenoid controlled valve 26 which is operated by a vehicle speed sensor 25 and communicates with air filter 18. The solenoid controlled valve 26 is constructed so that the passageway 31 is opened as denoted by arrow C when it is in the ON state, and the passageway 30 communicates with the port 10 when it is in the OFF state as denoted by arrow D. The numerals 27 denotes the supercharger, 28 the engine, 29 the relief port, and 30 the atmospheric port.

The supercharged pressure in the surge tank 8 is released by operating the relief valve 6 by means of the switch valve 7 at the time of reduced speed or idling. That is, since the throttle valve port 15 is at a negative pressure at the time of reduced speed and idling and the negative pressure flows in chamber 7A through the third port 16 of the switch valve 7, the second diaphragm 21 moves rightward in the drawing against the spring 24. As a result, the second valve 22 opens the fourth port 17 and the passageway 35 communicates with the second port 11 through the sixth port 20. Thus the negative pressure flows into the chamber 6B of the relief valve 6 through the second port 11, so that the first diaphragm 12 moves rightward in the drawing against the spring 13, the first valve 9 opens, and the air supply pressure in the surge tank 8 is released to the relief port 29.

In normal speed running, the supercharged pressure is controlled by a predetermined operating pressure of the relief valve 6. That is, since the throttle 14 is in an open state as shown by the dotted line at the time of high speed or normal speed run of the engine 28, the throttle valve port 15 is at a negative pressure smaller than the predetermined operating pressure of the switch valve 7 or at the atmospheric pressure or positive pressure. Therefore, the second diaphragm 21 of the switch valve and second valve 22 moves leftward in the drawing, the second valve 22 closes the fourth port 17. Ambient air, which flows in the chamber 7B of the switch valve 7 through the fifth port 19, further flows into the chamber 6B of the relief valve 6 through the opening 36A of the partition 36, the chamber 7C, the sixth port 20 and the passageway 33. As the result, the first diaphragm 12 and the first valve 9 move leftward in the drawing and the valve is in a closed state. In this state, the supercharged pressure in the surge tank 8 is maintained at the predetermined pressure until the first valve 9 is pushed up and opened. The interior of the surge tank 8 is controlled to be at a constant pressure by relief of the first valve 9.

During high speed running, the relief valve 6 is operated by the solenoid controlled valve 26 to release the supercharged pressure in the surge tank 8. That is, when running at a speed higher than a predetermined speed such as legal maximum speed, the solenoid controlled valve 26 is operated (turned on) by the vehicle speed sensor so that the pressure in the surge tank 8 directly pushes up the first diaphragm 12 through the first port 10. As the result, the supercharged pressure in the surge tank acts upon the first valve 9 and the first diaphragm 12 and the valve opens at a low pressure to release the pressure.

During running at a speed lower than a predetermined speed, the solenoid controlled valve 26 is in an off state and the atmospheric air is introduced into the chamber 6A of the relief valve 6 through passageway 30 of the atmospheric air port of the solenoid controlled valve 26 and the first port 10 whereby the diaphragm chamber is communicated with the atmospheric pressure. In this case, the supercharged pressure in the surge tank 8 is controlled by the predetermined operating pressure of the relief valve 6.

It should be understood that, although the preferred embodiment of the present invention has been described herein in considerable detail, certain modifications, changes, and adaptations may be made by those skilled in the art and that it is hereby intended to cover all modifications, changes and adaptations thereof falling within the scope of the appended claims.

What is claimed is:

1. A supercharged pressure controller for an internal combustion engine having an engine air intake passageway including a carburetor with a throttle valve, comprising:

a supercharger located upstream of the carburetor, a surge tank located between said supercharger and the carburetor, a relief valve connected to said surge tank for releasing air from the surge tank when it opens, a switch valve communicating with ambient air, and a port formed downstream of the throttle valve, a vehicle speed sensor;

a solenoid controlled valve connected to said vehicle speed sensor and communicating with ambient air, said surge tank and said relief valve, said switch valve being so constructed as to supply a negative pressure or an ambient air pressure to said relief valve according to a pressure generated at said port formed downstream of the throttle valve, said relief valve being so constructed as to be opened when the difference between the pressure in the surge tank and the pressure supplied to the relief valve from said switch valve exceeds a predetermined degree, and said solenoid controlled valve being so constructed as to make said relief valve communicate with said surge tank when the vehicle speed exceeds a predetermined value to assist the opening action of the relief valve.

2. A supercharged pressure controller for an internal combustion engine of claim 1 wherein:

said relief valve has a diaphragm and a valve member fixed to said diaphragm so as to define a first chamber having a port communicating with said solenoid controlled valve and a second chamber having a port communicating with said switch valve.

* * * * *